US007196632B2

(12) United States Patent
Hsiao

(10) Patent No.: US 7,196,632 B2
(45) Date of Patent: Mar. 27, 2007

(54) GAS SAFETY DETECTOR HAVING SELF-DETECTION FUNCTION

(76) Inventor: San-I Hsiao, 37, Xin Xing St., Jiayi (TW)

( * ) Notice: Subject to any disclaimer, the term of this patent is extended or adjusted under 35 U.S.C. 154(b) by 262 days.

(21) Appl. No.: 10/945,389

(22) Filed: Sep. 20, 2004

(65) Prior Publication Data

US 2006/0061479 A1 Mar. 23, 2006

(51) Int. Cl.
*G08B 17/00* (2006.01)

(52) U.S. Cl. ..... 340/632; 340/514; 340/627; 73/1.05

(58) Field of Classification Search ..... 340/632, 340/532; 73/1.05, 40
See application file for complete search history.

(56) References Cited

U.S. PATENT DOCUMENTS 6,906,637 B2 * 6/2005 Martin ..... 340/870.02
6,995,678 B2 * 2/2006 Wey ..... 340/632
7,034,667 B2 * 4/2006 Redfield ..... 340/433

* cited by examiner

*Primary Examiner*—Jeffery Hofsass
*Assistant Examiner*—Hoi C. Lau
(74) *Attorney, Agent, or Firm*—Alan D. Kamrath; Nikolai & Mersereau, P.A.

(57) ABSTRACT

A gas safety detector having a self-detection function includes a base board, an electromagnet, a gas device, a magnetically attractive plate, and a sensor. Thus, the gas safety detector has a self-detection function. In addition, when the electromagnet stops operating due to a malfunction or electric shutoff, the magnetically attractive plate is released to release the hook portion which releases the nozzle of the gas device, so that the retractable nozzle of the gas device is returned to the original position immediately so as to stop flow of the gas, thereby preventing the gas from leaking outward so as to provide a protective effect.

10 Claims, 4 Drawing Sheets

GAS SAFETY DETECTOR HAVING SELF-DETECTION FUNCTION

BACKGROUND OF THE INVENTION

1. Field of the Invention

The present invention relates to a gas safety detector, and more particularly to a gas safety detector having a self-detection function.

2. Description of the Related Art

A conventional gas safety detector comprises a sensor mounted on the ceiling to detect existence of the gas. When the sensor detects that the gas concentration in a site, such as the house or the like, exceeds a predetermined limit, the gas safety detector emits an alarm signal by blinking, buzzing or the like so as to warn the user, thereby protecting the user's safety. However, the gas safety detector cannot be operated normally when the sensor is inoperative or worn out, thereby causing danger to the user.

A conventional gas safety detector having a self-detection function in accordance with the prior art shown in FIG. 4 comprises a base board 80, a step motor 81 mounted on a first side of the base board 80, a rotation member 82 rotatably mounted on the step motor 81, a drive rod 83 mounted on the rotation member 82 to rotate therewith, a gas device 84 mounted on a second side of the base board 80 and having an end provided with a retractable nozzle (not shown), a link 85 pivotally mounted on the base board 80 and having a first end rested on and driven by the drive rod 83 and a second end formed with a hook portion 850 hooked on the nozzle of the gas device 84, a substantially Z-shaped catch plate 87 having a first end secured on the base board 80 and a second end rested on a mediate portion of the link 85, and a sensor 86 mounted on the second side of the base board 80 and located adjacent to the nozzle of the gas device 84.

In operation, the rotation member 82 is rotated by the step motor 81 to rotate the drive rod 83 which presses and moves the first end of the link 85 to pivot the link 85 by a leverage action to drive the hook portion 850 of the second end of the link 85 to pull the nozzle of the gas device 84 outward, so that the gas contained in the gas device 84 is ejected outward. At this time, the link 85 is limited by the catch plate 87 to prevent deflection of the link 85 due to an excessive hit of the drive rod 83. In practice, when the sensor 86 is operated at the normal state, the sensor 86 can detect the escaped gas from the nozzle of the gas device 84 and emits a warning signal in an optical or audible manner. Alternatively, when the sensor 86 is not operated at the normal state, the sensor 86 cannot detect the escaped gas from the nozzle of the gas device 84 and emits a warning signal after the gas enters the sensor 86, so that the sensor 86 needs to be repaired or replaced for safety. After the gas is ejected outward from the gas device 84, the step motor 81 is operated reversely to return the drive rod 83 to the original position to release the link 85 which releases the hook portion 850, so that the retractable nozzle of the gas device 84 is returned to the original position to stop flow of the gas. In such a manner, the gas enters the sensor 86 to perform a self test so as to identify if the sensor 86 is operated at the normal state, so that the gas safety detector has a self-detection function to detect the working state of the sensor 86 so as to ensure the safety o f the gas safety detector when in use.

However, movement of the link 85 is limited by the catch plate 87, so that when the pressing force of the catch plate 87 is too large, operation of the link 85 is interrupted so that the link 85 cannot return to its original position easily, and when the pressing force of the catch plate 87 is too small, the link 85 is easily driven by the drive rod 83 to move upward to have an inclined angle, so that the catch plate 87 is jammed by the link 85. In addition, the step motor 81 is in line with the link 85, and the gas device 84 is perpendicular to the link 85, so that the conventional gas safety detector has a larger volume, thereby occupying a larger space. Further, the step motor 81 increases costs of the conventional gas safety detector. Further, when the step motor 81 stops operating due to a malfunction or electric shutoff, movement of the drive rod 83 is stopped, and the hook portion 850 of the link 85 still pulls the nozzle of the gas device 84 outward, so that the gas contained in the gas device 84 is ejected outward successively, thereby causing danger.

SUMMARY OF THE INVENTION

In accordance with the present invention, there is provided a gas safety detector, comprising:

a base board;

an electromagnet mounted on a first side of the base board;

a gas device mounted on a second side of the base board and having an end provided with a retractable nozzle;

a magnetically attractive plate pivotally mounted on the base board and having a first end aligned with and driven by the electromagnet and a second end secured on the nozzle of the gas device; and a sensor mounted on the base board and located adjacent to the nozzle of the gas device.

The primary objective of the present invention is to provide a gas safety detector having a self-detection function.

Another objective of the present invention is to provide a gas safety detector, wherein the magnetically attractive plate is directly driven by the magnetic force of the electromagnet, so that the magnetically attractive plate is operated stably without deflection or detachment.

A further objective of the present invention is to provide a gas safety detector, wherein the electromagnet and the gas device are located at the same side of the magnetically attractive plate, so that the gas safety detector has a smaller volume, thereby saving space of operation, and thereby decreasing costs of fabrication.

A further objective of the present invention is to provide a gas safety detector, wherein the gas safety detector has a smaller volume, thereby facilitating package, storage and transportation of the gas safety detector.

A further objective of the present invention is to provide a gas safety detector, wherein when the electromagnet stops operating due to a malfunction or electric shutoff, the first end of the magnetically attractive plate is released to release the hook portion which releases the nozzle of the gas device, so that the retractable nozzle of the gas device is returned to the original position immediately so as to stop flow of the gas, thereby preventing the gas from leaking outward, and thereby providing a protective effect.

Further benefits and advantages of the present invention will become apparent after a careful reading of the detailed description with appropriate reference to the accompanying drawings.

DETAILED DESCRIPTION OF THE INVENTION

Figure 1:
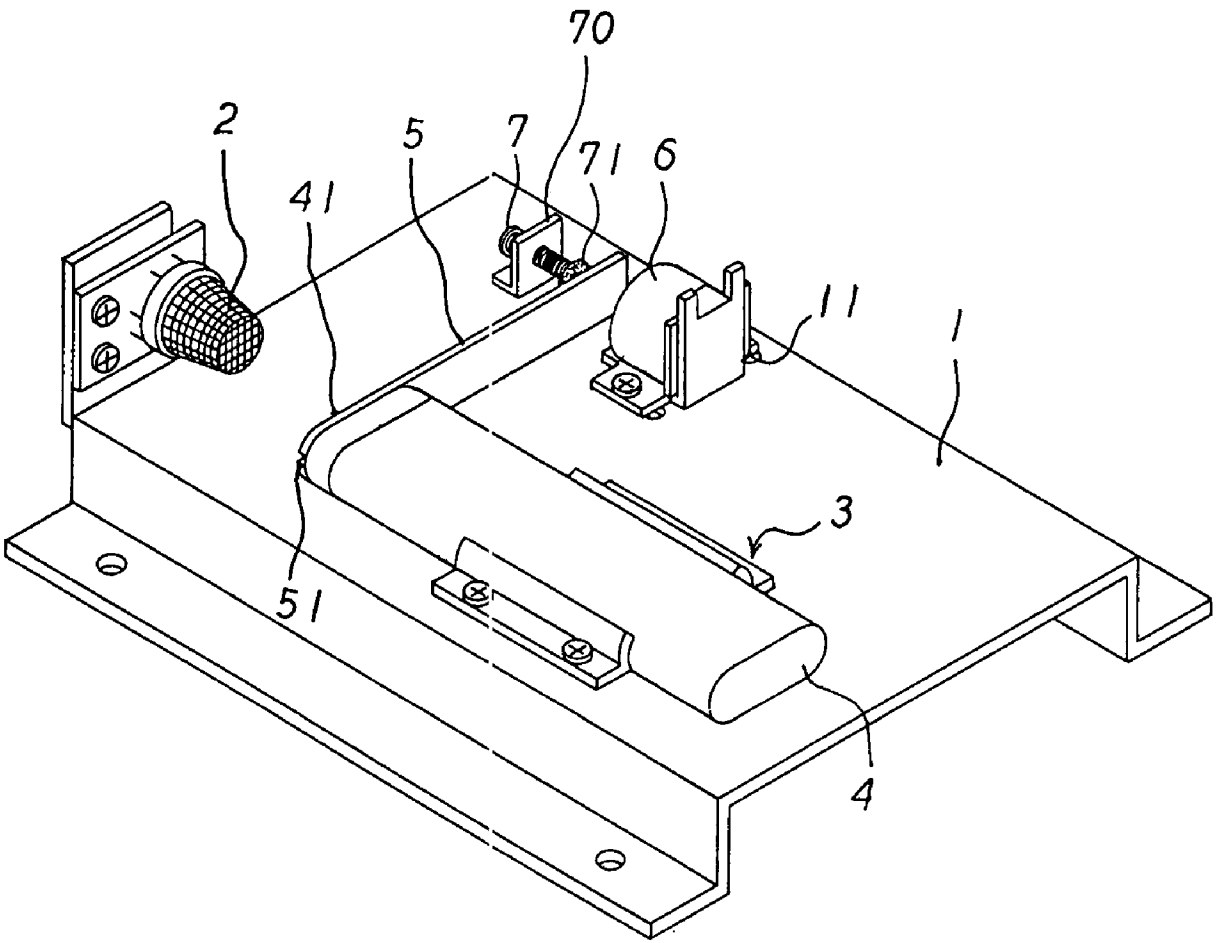
FIG. 1 is a perspective view of a gas safety detector in accordance with the preferred embodiment of the present invention.
Figure 2:
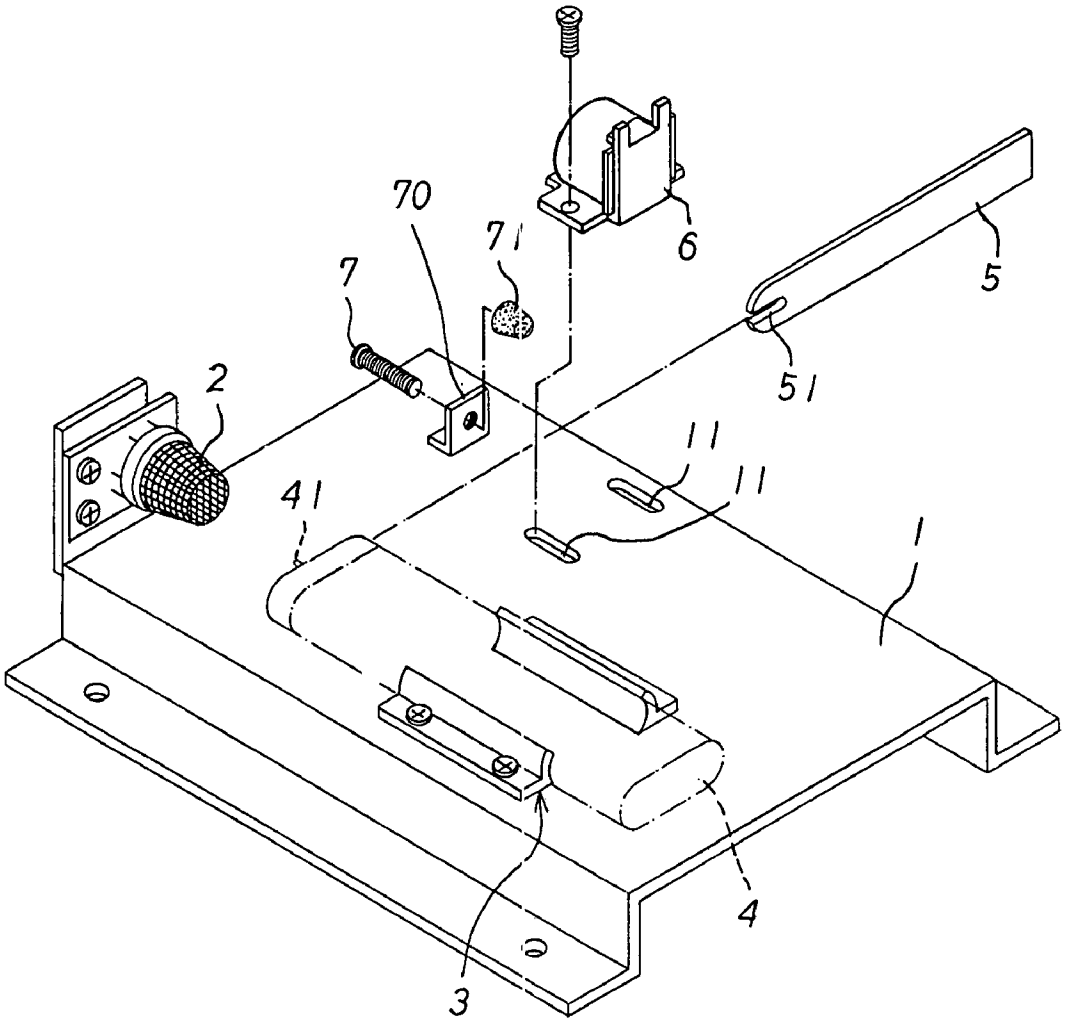
FIG. 2 is an exploded perspective view of the gas safety detector as shown in FIG. 1.

Referring to the drawings and initially to FIGS. 1 and 2, a gas safety detector in accordance with the preferred embodiment of the present invention comprises a base board 1, an electromagnet 6 mounted on a first side of the base board 1, a gas device 4 mounted on a second side of the base board 1 and having an end provided with a retractable nozzle 41, a magnetically attractive plate 5 pivotally mounted on the base board 1 and having a first end aligned with and driven by the electromagnet 6 and a second end secured on the nozzle 41 of the gas device 4, and a sensor 2 mounted on the base board 1 and located adjacent to the nozzle 41 of the gas device 4.

Preferably, the magnetically attractive plate 5 is perpendicular to the electromagnet 6 and the gas device 4, and the gas device 4 is parallel with the electromagnet 6. In addition, the electromagnet 6 and the gas device 4 are located at the same side of the magnetically attractive plate 5.

The electromagnet 6 is adjustably mounted on the base board 1. The first side of the base board 1 is formed with two spaced elongated adjusting slots 11 for mounting the electromagnet 6, so that the electromagnet 6 is movably and adjustably mounted on the base board 1.

The gas safety detector further comprises a threaded support plate 70 mounted on the first side of the base board 1, a threaded adjusting rod 7 is rotatably mounted on the support plate 70, and an insulating jacket 71 mounted on a distal end of the adjusting rod 7 to move therewith and rested on the first end of the magnetically attractive plate 5 to push the magnetically attractive plate 5, so that the magnetically attractive plate 5 is perpendicular to the electromagnet 6.

Preferably, the first end of the magnetically attractive plate 5 is spaced from the electromagnet 6 with a determined distance. The second end of the magnetically attractive plate 5 is formed with a hook portion 51 hooked on the nozzle 41 of the gas device 4. The gas safety detector further comprises two positioning members 3 each mounted on the second side of the base board 1 and rested on the gas device 4 to position the gas device 4 on the second side of the base board 1.

Figure 3:
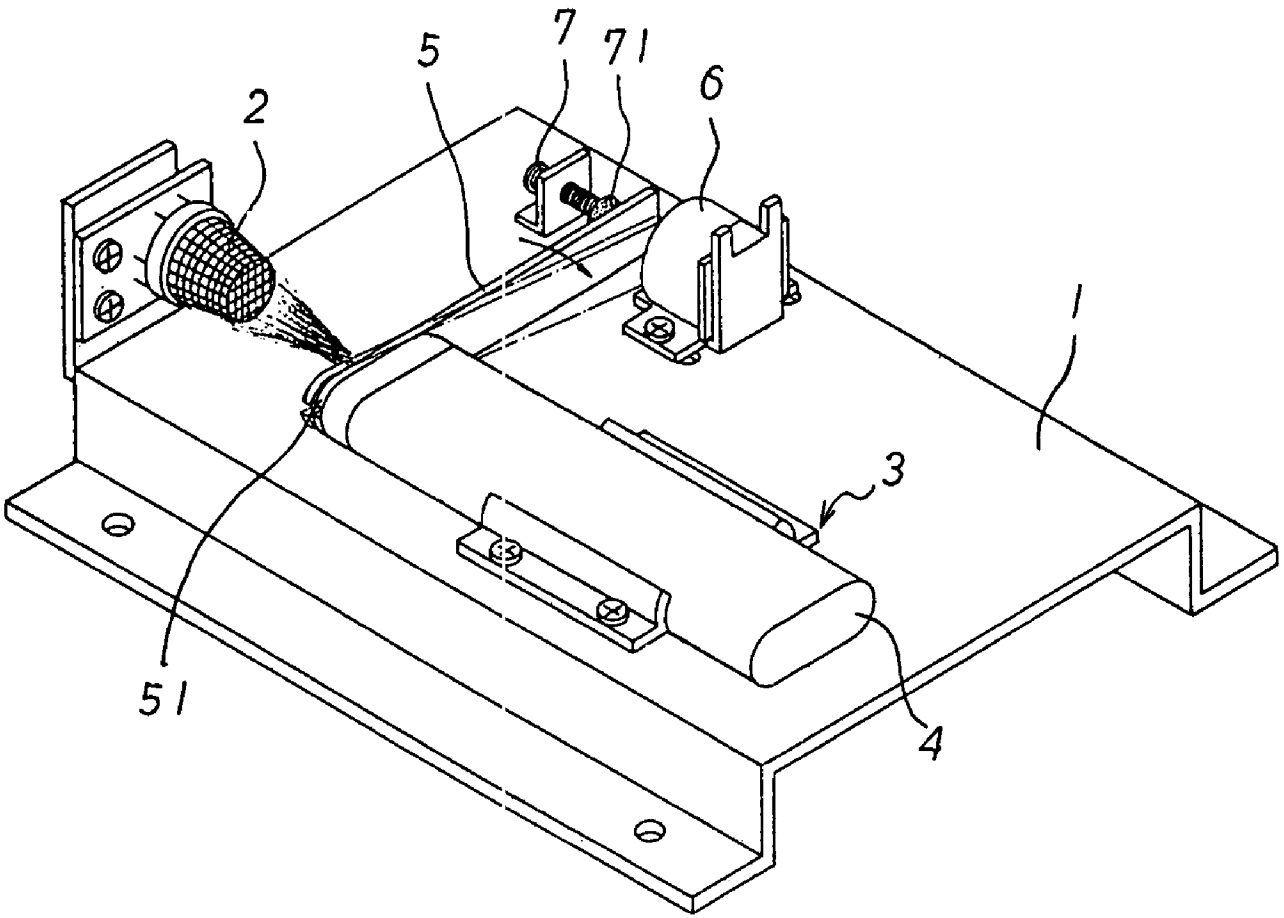
FIG. 3 is a schematic operational view of the gas safety detector as shown in FIG. 1.
Figure 4:
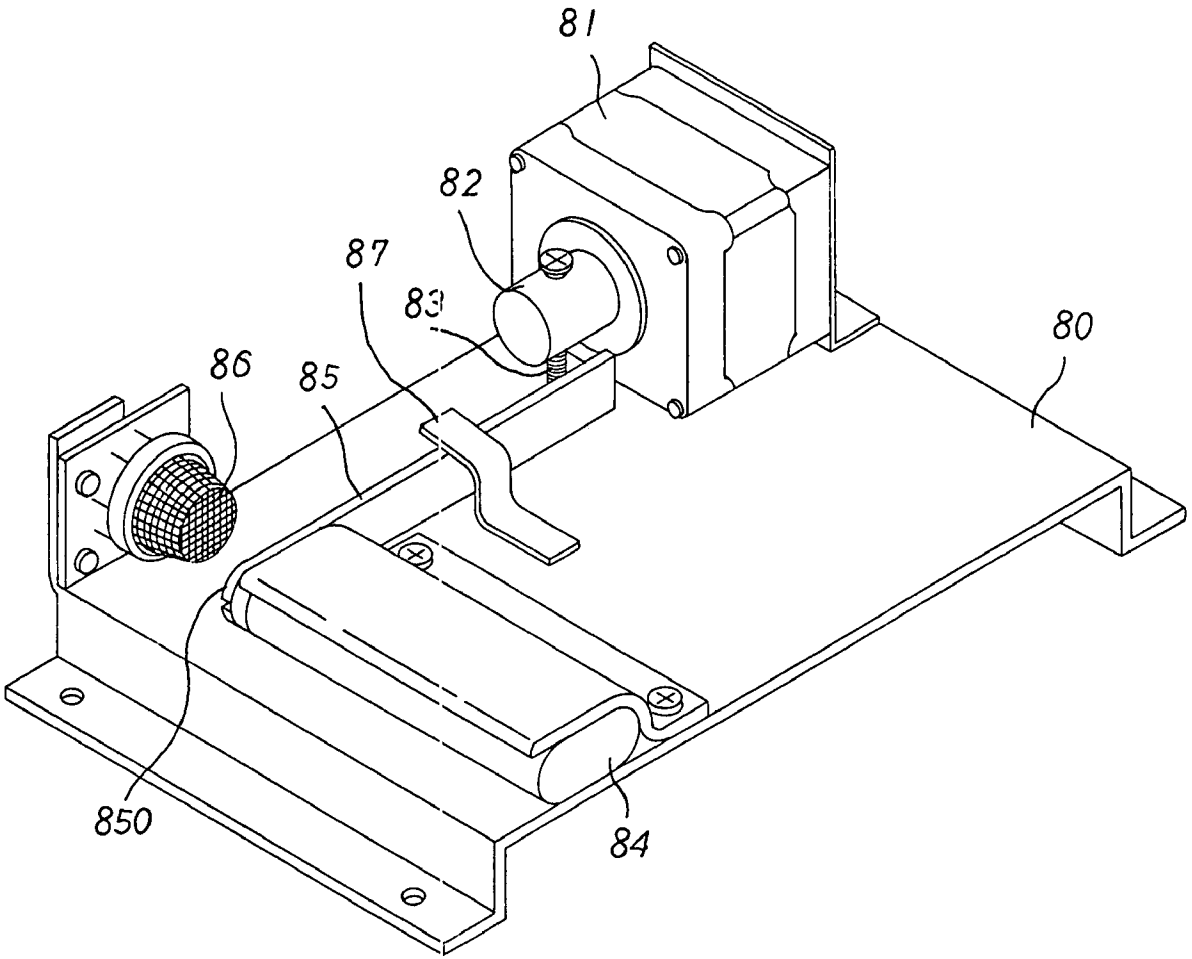
FIG.4 PRIOR ART
FIG. 4 is a perspective view of a conventional gas safety detector in accordance with the prior art.

In operation, referring to FIGS. 1–3, when the electromagnet 6 is energized and excited, the first end of the magnetically attractive plate 5 is magnetically attracted and moved by the electromagnet 6 to move and pivot the magnetically attractive plate 5 by a leverage action to drive the hook portion 51 of the second end of the magnetically attractive plate 5 to pull the nozzle 41 of the gas device 4 outward, so that the gas contained in the gas device 4 is ejected outward.

In practice, when the sensor 2 is operated at the normal state, the sensor 2 can detect the escaped gas from the nozzle 41 of the gas device 4 and emits a warning signal in an optical or audible manner (by blinking or buzzing). Alternatively, when the sensor 2 is not operated at the normal state, the sensor 2 cannot detect the escaped gas from the nozzle 41 of the gas device 4 to emit a warning signal after the gas enters the sensor 2, so that the sensor 2 needs to be repaired or replaced for safety.

After the gas is ejected outward from the gas device 4, the magnetic force of the electromagnet 6 is stopped by cutting the electric power so as to release the first end of the magnetically attractive plate 5 which releases the hook portion 51 which releases the nozzle 41 of the gas device 4, so that the retractable nozzle 41 of the gas device 4 is returned to the original position to stop flow of the gas.

In such a manner, the gas enters the sensor 2 to perform a self test so as to identify if the sensor 2 is operated at the normal state, so that the gas safety detector has a self-detection function to detect the working state of the sensor 2 so as to ensure the safety of the gas safety detector when in use.

Accordingly, the magnetically attractive plate 5 is directly driven by the magnetic force of the electromagnet 6, so that the magnetically attractive plate 5 is operated stably without deflection or detachment. In addition, the electromagnet 6 and the gas device 4 are located at the same side of the magnetically attractive plate 5, so that the gas safety detector has a smaller volume, thereby saving space of operation, and thereby decreasing costs of fabrication. Further, the gas safety detector has a smaller volume, thereby facilitating package, storage and transportation of the gas safety detector. Further, when the electromagnet 6 stops operating due to a malfunction or electric shutoff, the first end of the magnetically attractive plate 5 is released to release the hook portion 51 which releases the nozzle 41 of the gas device 4, so that the retractable nozzle 41 of the gas device 4 is returned to the original position immediately so as to stop flow of the gas, thereby preventing the gas from leaking outward, and thereby providing a protective effect.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A gas safety detector, comprising:

a base board;

an electromagnet mounted on a first side of the base board;

a gas device mounted on a second side of the base board and having an end provided with a retractable nozzle;

a magnetically attractive plate pivotally mounted on the base board and having a first end aligned with and driven by the electromagnet and a second end secured on the nozzle of the gas device;

a sensor mounted on the base board and located adjacent to the nozzle of the gas device;

a threaded support plate mounted on the first side of the base board;

a threaded adjusting rod rotatably mounted on the support plate;

an insulating jacket mounted on a distal end of the adjusting rod to move therewith and rested on the first end of the magnetically attractive plate to push the magnetically attractive plate, so that the magnetically attractive plate is perpendicular to the electromagnet.

2. The gas safety detector in accordance with claim 1, wherein the magnetically attractive plate is perpendicular to the gas device.

3. The gas safety detector in accordance with claim 1, wherein the gas device is parallel with the electromagnet.

4. The gas safety detector in accordance with claim 1, wherein the electromagnet and the gas device are located at the same side of the magnetically attractive plate.

5. The gas safety detector in accordance with claim 1, wherein the electromagnet is adjustably mounted on the base board.

6. The gas safety detector in accordance with claim 1, wherein the first side of the base board is formed with two spaced elongated adjusting slots for mounting the electromagnet, so that the electromagnet is movably and adjustably mounted on the base board.

7. The gas safety detector in accordance with claim 1, wherein the first end of the magnetically attractive plate is spaced from the electromagnet with a determined distance.

8. The gas safety detector in accordance with claim 1, wherein the second end of the magnetically attractive plate is formed with a hook portion hooked on the nozzle of the gas device.

9. A gas safety detector, comprising:

a base board;

an electromagnet mounted on a first side of the base board;

a gas device mounted on a second side of the base board and having an end provided with a retractable nozzle;

a magnetically attractive plate pivotally mounted on the base board and having a first end aligned with and driven by the electromagnet and a second end secured on the nozzle of the gas device;

a sensor mounted on the base board and located adjacent to the nozzle of the gas device;

two positioning members each mounted on the second side of the base board and rested on the gas device to position the gas device on the second side of the base board.

10. The gas safety detector in accordance with claim 1, wherein when the electromagnet is energized and excited, the first end of the magnetically attractive plate is magnetically attracted and moved by the electromagnet to move and pivot the magnetically attractive plate by a leverage action to drive the hook portion of the second end of the magnetically attractive plate to pull the nozzle of the gas device outward, so that a gas contained in the gas device is ejected outward.

* * * * *